US005544388A

United States Patent [19]

Chiura

[11] Patent Number: 5,544,388

[45] Date of Patent: Aug. 13, 1996

[54] STOPPER STRUCTURE FOR A LID MEMBER

[75] Inventor: Tatsuo Chiura, Saitama-ken, Japan

[73] Assignee: Honda Giken Kogyo Kabushiki Kaisha, Tokyo, Japan

[21] Appl. No.: 263,662

[22] Filed: Jun. 22, 1994

[30] Foreign Application Priority Data

Aug. 27, 1993 [JP] Japan ..... 5-235586

[51] Int. Cl.[6] ..... E05F 5/06

[52] U.S. Cl. ..... 16/375; 16/86 B; 16/86 R; 16/289

[58] Field of Search ..... 16/86 A, 86 B, 16/86 C, 86 R, 287, 288, 294, 371, 375

[56] References Cited

U.S. PATENT DOCUMENTS

| | | | |
|---|---|---|---|
| 4,012,807 | 3/1977 | Kern | 16/375 |
| 4,679,841 | 7/1987 | Taunay | 16/288 |
| 5,339,494 | 8/1994 | Esau et al. | 16/294 |

FOREIGN PATENT DOCUMENTS

| | | | |
|---|---|---|---|
| 596947 | 11/1925 | France | 16/371 |
| 1449081 | 7/1966 | France | 16/375 |
| 2699217 | 6/1994 | France | 16/375 |
| 23785 | 10/1902 | United Kingdom | 16/375 |
| 1273876 | 5/1972 | United Kingdom | 16/375 |
| 2241020 | 8/1991 | United Kingdom | 16/375 |

*Primary Examiner*—M. Rachuba
*Assistant Examiner*—Donald M. Gurley
*Attorney, Agent, or Firm*—Armstrong, Westerman, Hattori, McLeland & Naughton

[57] ABSTRACT

Provided is an improved stopper structure for defining both opening and closing limits of a lid member such as a trunk lid of an automobile requiring only a minimum number of component parts and a minimum amount of work for the fabrication process. The stopper for defining the opening and closing limits of a lid member attached to a vehicle body via a four-link mechanism 1 comprises a stopper member secured to an inner surface of the lid member, a first abutting surface provided in one of the link arms for engaging the stopper member when the lid member is opened up, and a second abutting surface provided on the vehicle body for engaging the stopper member when the lid member is fully closed. In particular, it is preferable to provide the stopper member with a plurality of contact surfaces having different heights substantially symmetrically around a mounting portion thereof.

7 Claims, 3 Drawing Sheets

STOPPER STRUCTURE FOR A LID MEMBER

TECHNICAL FIELD

The present invention relates to a stopper structure for defining a fully open position and a fully closed position of a lid member, such as an engine hood for covering an engine room or a trunk lid for covering a trunk space of an automobile, which is hinged to a fixed member such as a vehicle body via a linkage hinge mechanism such as a four-link mechanism.

BACKGROUND OF THE INVENTION

An engine hood and a trunk lid of an automobile are desired to be opened up as widely as possible so that the access to the engine room and the trunk space may be improved, and hinge mechanisms making use a four-link mechanism including four links having different lengths are sometimes used for the purpose of maximizing the opening angle.

A four-link mechanism is sometimes called as a quadric crank chain, and can achieve various sorts of hinge motion by suitably selecting the lengths of the four links which make up the mechanism. Because a four-link mechanism basically provides a larger link rotational angle than actually required, it is necessary to define the fully open position and the fully closed position of the lid member by suitable means. Typically, a stopper member, for instance made of rubber, is interposed between a suitable point of the inner surface of the lid member and a corresponding position of the vehicle body to define the fully closed position, and the rotational angle is limited by another means so as to define the fully open position of the lid member.

According to the conventional structure, separate stoppers were typically provided for the fully open position and the fully closed position, and the number of component parts and the amount of the work involved in the fabrication process were inevitably substantial.

BRIEF SUMMARY OF THE INVENTION

In view of such problems of the prior art, a primary object of the present invention is to provide a stopper structure for a lid member hinged to a fixed member such as a vehicle body for defining a fully open position and a fully closed position of the lid member which is simple in structure.

A second object of the present invention is to provide such a stopper structure for a lid member which allows the fully open position and the fully closed position of the lid member to be adjusted in a simple manner.

A third object of the present invention is to provide such a stopper structure for a lid member which is durable in use.

These and other objects of the present invention can be accomplished by providing a stopper structure for defining opening and closing limits of a lid member attached to a fixed member via a linkage hinge mechanism, comprising: a stopper member fixedly secured to an inner surface of the lid member; a first abutting surface formed on a link arm of the linkage hinge mechanism for engaging the stopper member when the lid member is fully opened; and a second abutting surface formed on the fixed member for engaging the stopper member when the lid member is fully closed.

Thus, the rotatable range of the lid member is defined by the common stopper member provided on the lid member by abutting the fixed member such as a vehicle body in the fully closed position, and by abutting the link arm in the fully open position.

Typically, with the aim of maximizing the opening angle of the lid member, the linkage hinge mechanism comprises a body fixture fixedly mounted on the fixed member, a pair of link arms pivotally attached to the body fixture at base ends thereof, and a lid fixture fixedly mounted on the lid member and pivotally attached to free ends of the link arms. Thus, the body fixture, the two link arms, and the lid fixture form the four links in the four-link mechanism. The lid fixture and the body fixture may also be used for engaging a cylindrical damper for counter-acting or otherwise controlling the movement of the lid member between them.

If the stopper member defines a plurality of contact surfaces for cooperating with the first and second abutting surfaces that can be interchanged by changing a mounted position of a stopper member, it is possible to readily adjust the vertical height of the stopper member, or replace the worn out stopper surface with an unused stopper surface, by rotating or otherwise moving the mounted position of the stopper member. For instance, the stopper member may consist of rubber-like material, and comprise a central boss which is fitted into a support member, and a plurality of extensions defining the contact surfaces which are arranged as a substantially same distance so that a selected one of the contact surfaces may be placed in a position for engaging the first and second abutting surfaces by turning the stopper member around the central boss.

As an additional means for defining the fully closed position of the lid member, a third abutting surface may be defined in the body fixture for abutting a second stopper member fixedly mounted on the lid member. Thus, by changing the mounted position of the body fixture, it is possible to adjust the fully closed position of the lid member. By adjusting the two separate stoppers for defining the fully closed position of the lid member involving the use of the second and third abutting surfaces, it possible to adjust not only the vertical position but the inclination angle of the lid member at its fully closed position. Thus, the lid member may be attached to the fixed member such as a vehicle body so as to be accurately flush with the surrounding part of the fixed member or so as to favorably conform to the outer contour of the fixed member.

BRIEF DESCRIPTION OF THE DRAWINGS

Now the present invention is described in the following with reference to the appended drawings, in which.

DETAILED DESCRIPTION OF THE PREFERRED EMBODIMENTS

Figure 1:
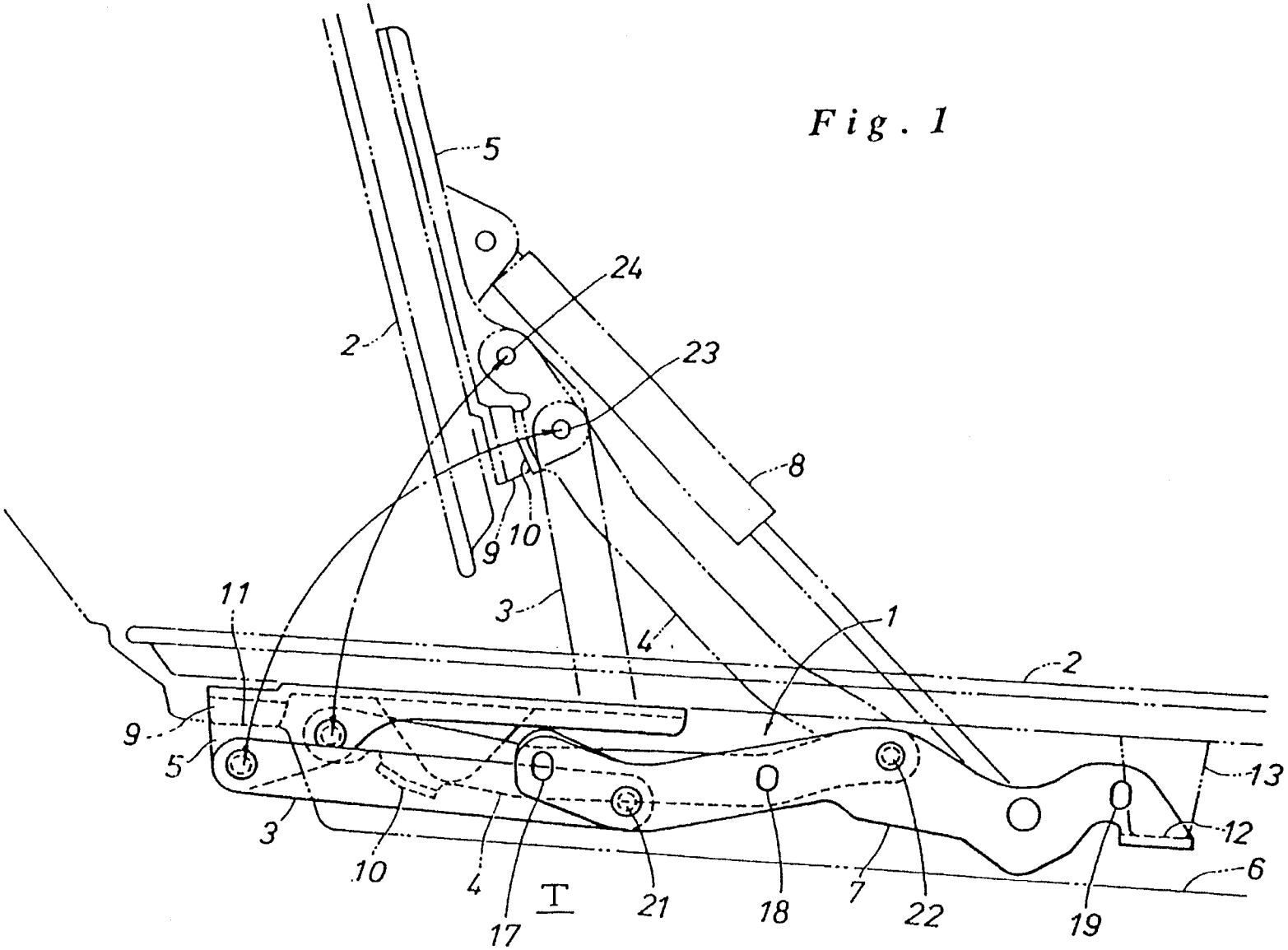
FIG. 1 is a side view of a hinge mechanism incorporating a stopper structure according to the present invention.
Figure 2:
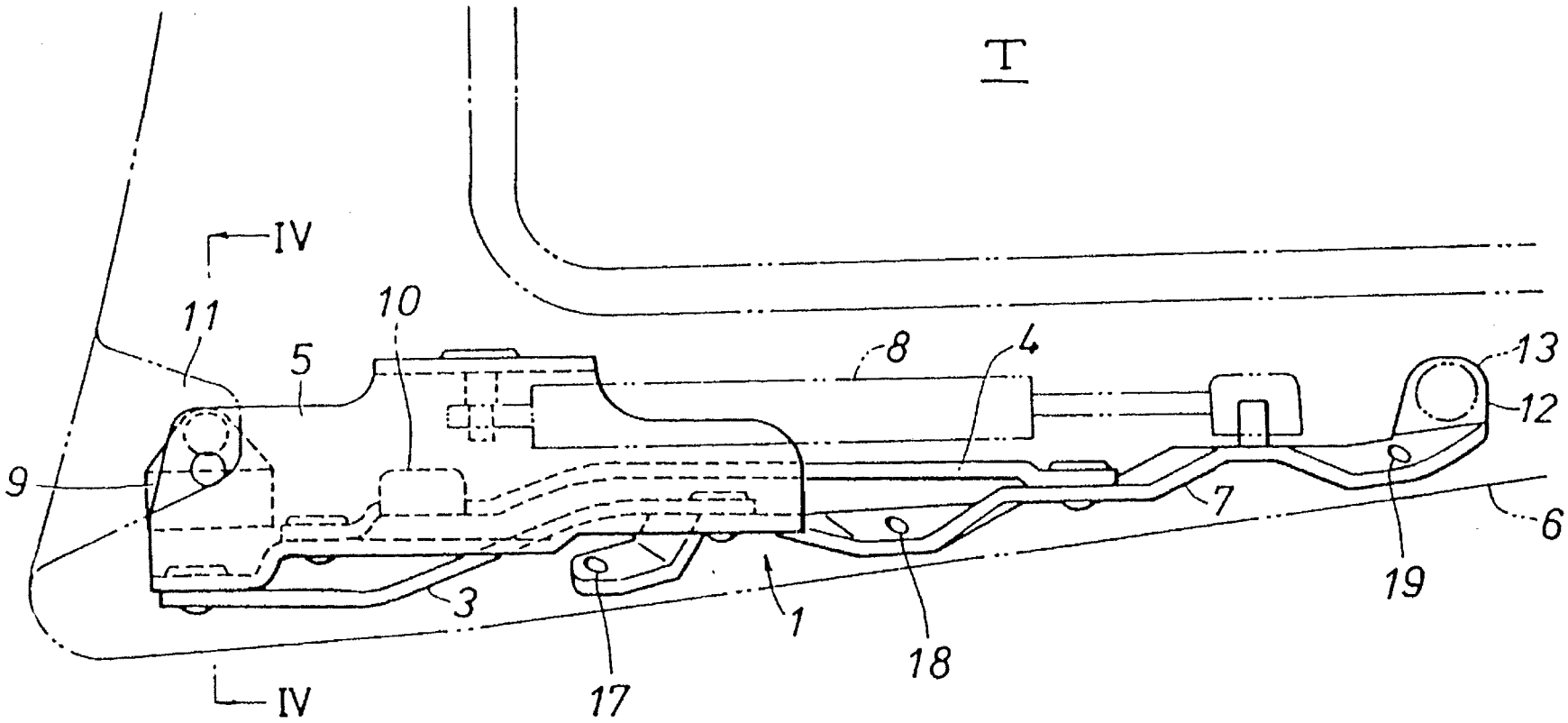
FIG. 2 is a plan view of the hinge mechanism.

FIGS. 1 and 2 show a trunk lid hinge mechanism to which the present invention is applied. A trunk lid 2 is attached to an upper end of a peripheral part of a trunk space opening T of a vehicle body 6 via a four-link mechanism 1. This four-link mechanism 1 comprises a short link arm 3, a long link arm 4, a lid fixture 5 fixedly secured to the inner surface of the trunk lid 2, and a body fixture 7 fixedly secured to the vehicle body 6. The base ends of the short and long link arms and 4 are pivotally attached to the body fixture 7 at pivotal points 21 and 22, respectively, and the free ends of the short and long link arms 3 and 4 are pivotally attached to the lid fixture 5 at pivotal points 23 and 24, respectively. Thus, four links are defined by the short and long link arms 3 and 4, the lid fixture 5, and the body fixture 7 which are pivotally joined at the pivotal points 21 through 23. A cylindrical damper 8 is engaged between the lid fixture 5 and the body fixture 7 to counteract the weight of the trunk lid 2 and control the speed of opening and closing the trunk lid 2.

To a part of the lid fixture 5 adjacent to the pivotal point 23 for the short link arm 3 is attached a stopper member 9 made of rubber material. To a part of the long link arm 4 adjacent to the pivotal point 24 for the lid fixture 5 is provided a lateral projection 10 which can engage the stopper member 9 when the trunk lid 2 is fully opened. A front end portion of the peripheral part of the trunk space opening T is provided with a seat surface 11 projecting therefrom for engaging the stopper member 9 when the trunk lid 2 is closed.

The stopper contact surface of the abutting surface of the projection 10 provided in the long link arm 4 has a convex contact surface. As a result, the force acting upon the stopper member 9 in the direction parallel to the lid surface is favorably dispersed when the stopper member 9 comes into contact with the projection 10, and the concentration of inner stress in a part of the stopper member 9 secured to the lid fixture 5 can be avoided, thus preventing damages to this part even after long use.

A rear end portion of the body fixture 7 is provided with a second lateral projection 12, and a second stopper member 13 made of rubber and mounted on the inner surface of the trunk lid 2 engages the upper surface of the second lateral projection 12 when the trunk lid 2 is closed. By thus providing a seat surface (the second projection 12), for engaging the second stopper member 13, on the body fixture 7 (instead of a peripheral part of the trunk space opening T which is typically used for guiding rain water and is thus exposed to rain water), even though the seat surface may have a tendency to lose its paint coating due to friction with the second stopper member 13 during use, as it is thus kept from moisture, formation of rust in the seat surface can be avoided.

It is important when assembling a lid member such as a trunk lid to adjust the fully closed position of the lid member to be flush with the surrounding part of the vehicle body. According to this embodiment, because the adjustment of the relative height between the trunk lid 2 and the vehicle body 6 can be accomplished simply by adjusting the mounting position of the body fixture 7, the assembling process can be simplified. For this purpose, the body fixture 7 is provided with a three slots 17 through 19 for adjustably mounting it on the vehicle body 6 with threaded fasteners. It should be noted that the adjustment of the mounting position of the body fixture 7 allows the angle of the trunk lid 2 in its fully closed position to be changed.

Figure 3:
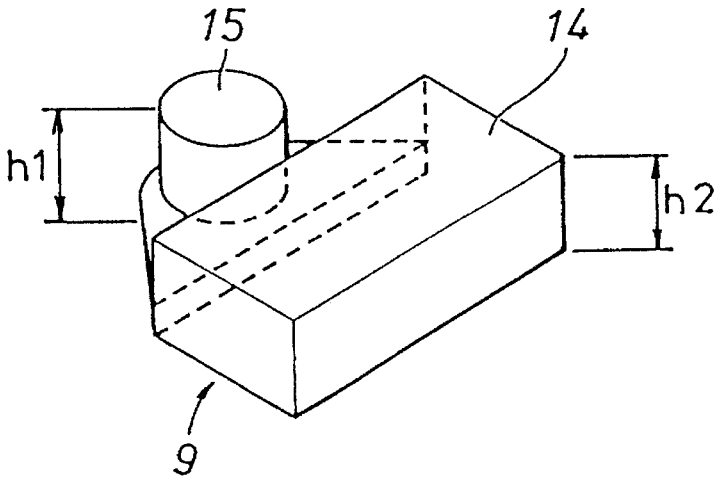
FIG. 3 is a perspective view of the stopper member.

The stopper member 9 consists of a rectangular projection 14 and a circular projection 15, and is thus asymmetric in the lateral direction as illustrated in FIG. 3. The two projections 14 and 15 have mutually different vertical dimensions ($h_1$ and $h_2$).

Figure 4:
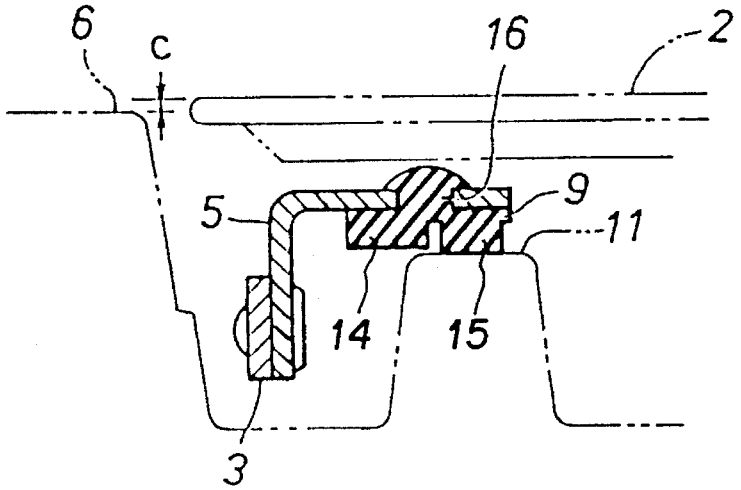
FIG. 4 a sectional view taken along line IV—IV of FIG. 2.

The rear surface of a part of the stopper member 9 intermediate between the two projections 14 and 15 is provided with a mounting boss 16 for the lid fixture 5 as illustrated in FIG. 4, and the end surfaces of the two projections 14 and 15 serving as the abutting surfaces can be interchanged by rotating the stopper member 9 by 180° around the mounting boss 16. Thus, the relative height between the trunk lid 2 and the vehicle body 6 (the dimension c given in FIG. 4) can be adjusted thanks to the difference in height between the two projections 14 and 15. Thus, by suitably adjusting the mounting position of the body fixture 7 as described above and adjusting the effective height of the stopper member 9, it is possible to adjust both the angle and the height of the trunk lid 2.

If a plurality of such projections having different heights are arranged around the mounting boss 16 in a symmetric fashion, it is possible to eliminate the need to replace the stopper member 9 even when the abutting surface is worn out simply by rotating the stopper member 9 so as to replace the worn out projection with another unused projection.

According to the hinge mechanism used in the above described embodiment, the fully closed position of the trunk lid 2 is defined by the stopper member 9 mounted on the lid fixture 5 engaged by the seat surface 11 formed in the peripheral part of the trunk space opening T of the vehicle body 6, and the second stopper member 13 mounted on the inner surface of the trunk lid 2 engaged by the second projection 12 formed in the body fixture 7. The fully open position of the trunk lid 2 is defined by the stopper member 9 mounted on the lid fixture 5 engaged by the projection 10 provided on the long link arm 4.

Thus, according to the present invention, because the fully open and closed positions of a trunk lid can be defined with a same stopper member, the number of component parts and the amount of work needed for the fabrication process can be both reduced. Furthermore, by providing a plurality of abutting surfaces symmetrically around a mounting portions, the adjustment of the relative height between the trunk lid and the vehicle body can be readily accomplished, and a necessary measure can be readily taken when the contact surface has worn out.

Although the present invention has been described in terms of a specific embodiment thereof, it is possible to modify and alter details thereof without departing from the spirit of the present invention. For instance, the hinge mechanism is not limited by the illustrated four-link mechanism, but may consist of other linkage hinge mechanisms as long as they provide a seat surface for engaging the stopper member 9 for defining the fully open position of the trunk lid 2 or other lid members.

What I claim is:

1. A stopper structure defining opening and closing limits of a lid member attached to a fixed member via a linkage hinge mechanism, comprising:

a stopper member fixedly secured to an inner surface of said lid member;

a first abutting surface formed on a link arm of said linkage hinge mechanism for engaging said stopper member when said lid member is fully opened; and a second abutting surface formed on said fixed member for engaging said stopper member when said lid member is fully closed.

2. A stopper structure according to claim 1, wherein said linkage hinge mechanism comprises a body fixture fixedly mounted on said fixed member, a pair of link arms pivotally attached to said body fixture at base ends thereof, and a lid fixture fixedly mounted on said lid member and pivotally attached to the other ends of said link arms.

3. A stopper structure according to claim 2, wherein a third abutting surface is defined in said body fixture for abutting a second stopper member fixedly mounted on said lid member.

4. A stopper structure according to claim 2, wherein said body fixture is provided with means for adjusting a mounted position of said body fixture.

5. A stopper structure according to claim 2, wherein a cylindrical damper is engaged between said lid fixture and said body fixture.

6. A stopper structure according to claim 1, wherein said stopper member defines a plurality of contact surfaces for cooperating with said first and second abutting surfaces that can be interchanged by changing a mounted position of said stopper member.

7. A stopper structure according to claim 6, wherein said stopper member consists of rubber-like material, and comprises a central boss which is fitted into a support member on the lid member, and a plurality of extensions defining said contact surfaces which are arranged at substantially the same distance from the central boss so that a selected one of said contact surfaces may be placed in a position for engaging said first and second abutting surfaces by turning said stopper member around said central boss.

* * * * *